US005986534A

United States Patent [19]

Stokes et al.

[11] Patent Number: 5,986,534

[45] Date of Patent: Nov. 16, 1999

[54] DROPOUT FUSE HAVING ELECTRICAL ENERGY ABSORBING DEVICE

[75] Inventors: Anthony D. Stokes, Sydney, Australia; Andrew Wolny, Gdansk, Poland

[73] Assignee: The University of Sydney, Australia

[21] Appl. No.: 08/581,520

[22] PCT Filed: Jul. 12, 1994

[86] PCT No.: PCT/AU94/00386

§ 371 Date: May 23, 1996

§ 102(e) Date: May 23, 1996

[87] PCT Pub. No.: WO95/02888

PCT Pub. Date: Jan. 26, 1995

[30] Foreign Application Priority Data

Jul. 12, 1993 [AU] Australia ..... PL 9907

[51] Int. Cl.[6] ..... H01H 71/10; H01H 85/35

[52] U.S. Cl. ..... 337/171; 337/166; 337/273; 337/280

[58] Field of Search ..... 337/176, 159, 337/169, 170, 181, 293, 273, 280

[56] References Cited

U.S. PATENT DOCUMENTS

| | | | |
|---|---|---|---|
| 3,737,724 | 6/1973 | Salge et al. | 361/8 |
| 3,827,010 | 7/1974 | Cameron et al. . | |
| 4,308,566 | 12/1981 | Imataki et al. | 361/125 |
| 4,528,536 | 7/1985 | Blewitt et al. . | |
| 5,463,366 | 10/1995 | Hassler et al. | 337/176 |

FOREIGN PATENT DOCUMENTS

| | | |
|---|---|---|
| 9085 790A | 5/1991 | Australia . |
| 2 586 858A | 6/1986 | France . |
| 763 090 | 1/1954 | Germany . |
| 947 813 | 8/1956 | Germany . |

*Primary Examiner*—Leo P. Picard
*Assistant Examiner*—Jayprakash N. Gandhi
*Attorney, Agent, or Firm*—Nikolai, Mersereau & Dietz, P.A.

[57] ABSTRACT

The present invention relates to a fuse arrangement, which is particularly suited to high voltage applications, but also has applications across a broad voltage range. The fuse arrangement comprises a fuse link arranged to be connected in a current carrying circuit and a parallel-connected resistor. On occurrence of a fault, conditioning the current carrying circuit, the fuse link is arranged to generate relatively high voltage such that current is commutated to the resistor and electrical energy associated with the fault current is absorbed by the resistor. The resistor element is preferably a varistor and, for high voltage applications, a fuse link preferably comprises a deeply confined expulsion fuse. Because electrical energy flowing in the circuit is diverted to the resistance element on occurrence of a fault condition, the current carrying circuit is thus protected from damage.

14 Claims, 11 Drawing Sheets

DROPOUT FUSE HAVING ELECTRICAL ENERGY ABSORBING DEVICE

BACKGROUND OF THE INVENTION

I. Field of the Invention

The present invention relates to a and, particularly, but not exclusively, to a fuse arrangement having application in high voltage current carrying circuits, such as found in country-wide electrical distribution networks.

Fuses are provided in electrical distribution networks to prevent damage from fault currents such as may be caused by overload and short-circuit conditions. The function of a fuse is to prevent large amounts of electrical energy flowing in the circuit in short periods of time, thereby avoiding damage to circuit components and devices connected to the circuit. To perform this energy limiting task, some fuses operate to, firstly, limit the current flowing in the current carrying circuit following the occurrence of a fault current and, secondly, to break the current carrying circuit to prevent further current flow.

Fuse operation is a complex process and breaking of a circuit takes a finite amount of time during which current will still be flowing. Hence the need, particularly in circuits generating high currents, for fuses which also perform a current limiting operation. Fuse operation generally involves fusing of the fuse element, formation of a fuse arc (at this time current is still flowing in the circuit) and cut-off of the fuse arc (at this stage current is "broken").

II. Description of Related Art

Sand fuses, consisting of a long fuse element surrounded by sand in a tube, are fuses which operate to cut-off current flow very rapidly following the occurrence of a fault current. They are said to have high "breaking capacity" and can cope with very large values of fault current (12 KA or more). The sand operates to "quench" the fuse arc, usually before the current wave-form has reached its peak (in an a.c. system). Sand fuses are said in the art to have a "current limiting" operation, because they operate to cut the current off very rapidly, together with a current breaking operation. They protect the circuit from damaging quantities of electrical energy by virtue of the rapid cut-off of current.

In another arrangement the fuse is mounted within metal or insulation enclosed switch gear, indoors or in pad mounted substations. In these applications a separate load break switch is provided to permit complete disconnection of all fuses in the event that one operates on fault current. The fuse usually incorporates a mechanical triggering device designed to operate the load break switch.

A problem with sand fuses is that their operation on occurrence of fault currents of relatively low value is limited. At a relatively low value current, the fuse element "burns back" and the arc is not quenched at all, resulting in a large amount of energy being dissipated in the sand fuse (possibly causing explosion).

In some current carrying circuits, such as in electrical distribution networks, for example, fault currents may occur which vary widely in their value. An ideal fuse in such circuits must be able to deal with fault currents of very large value (12 KA or more) as well as fault currents of relatively low value. Such fuses must have a wide "operating range".

It is possible to design sand fuses with a wide range, but this necessitates complicated and expensive process engineering of the fuse element and the provision of a back-up fuse to deal with the "minimum breaking-capacity" current (lowest value fault current at which the fuse must break the current carrying circuit). Such complex fuses are one-shot only and their replacement is expensive. That is, there is a relatively high cost of "fault clearing" for these fuses.

An expulsion fuse is a simple type of fuse merely comprising a fuse element which may extend in a tube, with no sand. The expulsion fuse element is generally relatively short compared with the elements used in sand fuses. Traditional expulsion fuses operate in a different way to sand fuses. They have no "current limiting" function, merely operating to break the current in the current carrying circuit. The fuse arc in an expulsion fuse is not quenched until current flow approaches naturally to zero. This means that up to half an a.c. wave form of current may flow before the circuit is broken. Such a long time of operation increases the energy dissipated in the fuse. To restrict this, moderate breaking currents only are permitted. That is why expulsion fuses only have medium rated breaking capacities. They are not useful with very large currents, such as some fault currents which can be expected in electrical distribution networks because the amount of electrical energy which may flow in the current carrying circuit may be sufficient to cause the fuse carrier (the housing mounting the fuse element) to explode, causing damage to the current carrying circuit in the immediate vicinity of the fuse. Even the medium rated expulsion fuses will operate with a very loud noise as the energy of the fuse arc is dissipated within them. Expulsion fuses, however, can operate at relatively low current levels. They are therefore suitable for low to medium range applications. In addition, they are relatively cheap and the cost of fault clearing with these types of fuses is low.

One known expulsion fuse is mounted in a carrier arranged to "drop out" mechanically from the circuit once the fuse element has broken. These are known as "drop out" fuses.

SUMMARY OF THE INVENTION

The present invention provides a fuse arrangement, comprising a fuse link mountable in series with a current carrying circuit, and an energy absorbing device connectable in parallel with the fuse link and arranged, on operation of the fuse arrangement on the occurrence of a fault current in the current carrying circuit, to absorb electrical energy associated with the fault current.

Rather than electrical energy flowing in the current carrying circuit and entirely through the fuse link, electrical energy flowing after occurrence of a fault current is almost entirely dissipated within the energy absorbing device.

In preferred embodiments of the present invention, therefore, a fuse link can be provided which is not required to dissipate large amounts of energy, and an insufficient amount of electrical energy will flow in the current carrying circuit to cause damage to the circuit and devices connected to it.

Preferably, the fuse arrangement also operates to break the current carrying circuit following the occurrence of a fault current.

Preferably, the fuse arrangement operates by commutation of current, on the occurrence of a fault current, from the fuse link to the energy absorbing device. Current flow through the fuse link therefore ceases and the fault current then flows through the energy absorbing device. In preferred embodiments, this has the advantage that the fuse link itself can be simple and cheap, as it is not required to be designed to dissipate large amounts of energy. It has no limit of breaking capacity.

The energy absorbing device is preferably arranged not to operate in its energy absorbing capacity until a relatively high voltage is applied to its terminals. By "relatively high voltage" is meant a voltage which would not normally be experienced at that point in the current carrying circuit, otherwise than on occurrence of a fault current or, for example, a lightning stroke. The value of this voltage will vary depending upon the current carrying circuit parameters and the consequent performance requirements for the fuse. The fuse link itself is preferably arranged to generate the relatively high voltage in a relatively short time after occurrence of the fault current. Preferably, the relatively high voltage is generated by the fuse link at the instant of arc ignition in the fuse link. The current in the fuse link will be cut and commutated to the energy absorption device before any significant amount of energy flows through the fuse link.

The energy absorbing device is preferably a high resistance device and, thus, operates to limit current flow in the current carrying circuit. The resistance should be low enough to ensure current commutation but also high enough to limit the current flowing in the circuit. The type of fuse link used and the type of high resistance device used will obviously vary depending upon the qualities of the current carrying circuit and the performance requirements for the fuse. For high voltage/high currents circuits, such as electrical distribution networks, a preferred high resistance element is a zinc oxide varistor, such as the type which are used in lightning arresters and which have high energy handling capabilities.

In a preferred embodiment, the fuse link comprises a standard expulsion fuse element (its qualities will depend on performance requirement) which is adapted to generate a relatively high voltage on occurrence of a fault current. For high voltage/high current applications, the expulsion fuse element is preferably "deeply confined" by running the fuse element in a long and narrow diameter tube (for example, a capillary tube). On the occurrence of a fault current this will cause the relatively high voltage to be generated rapidly causing rapid commutation of current to the energy absorbing device.

Fuse arrangements in accordance with the present invention can, at least in preferred embodiments, be manufactured with high ranges to operate on fault currents of relatively low value and fault currents of relatively high value. Further, as the fuse link and energy absorbing element can be simple in construction, the cost of fault clearing, in at least preferred embodiments, is low. In one preferred embodiment, a "drop-out" type carrier is used for the fuse arrangement to break the current carrying circuit following occurrence of fault current.

In a further embodiment, a breaking current fuse is connected in series with the parallel arrangement of fuse link and energy absorbing device.

In yet a further alternative embodiment, the invention extends to cover applications where the fuse is mounted in a plastic or insulation enclosed switch gear and a separate load break switch is provided. In this embodiment the fuse arrangement incorporates a mechanical triggering device designed to operate the load break Switch

BRIEF DESCRIPTION OF THE DRAWINGS

Features and advantages of the present invention will become apparent from the following description of embodiments thereof, by way of example only, with reference to the accompanying drawings in which.

DETAILED DESCRIPTION OF THE PREFERRED EMBODIMENT

Embodiments of the present invention will now be described which are particularly designed for high voltage/high current applications. It will be appreciated that the fuse arrangement of the present invention may be used for any fuse application in any type of circuit, including low voltage/low current circuits and d.c. circuits, where an arrangement may be required which utilises an energy absorbing device in conjunction with a fuse link. It will be appreciated that the operating parameters of the fuse arrangement will vary depending upon the application.

Figure 1:
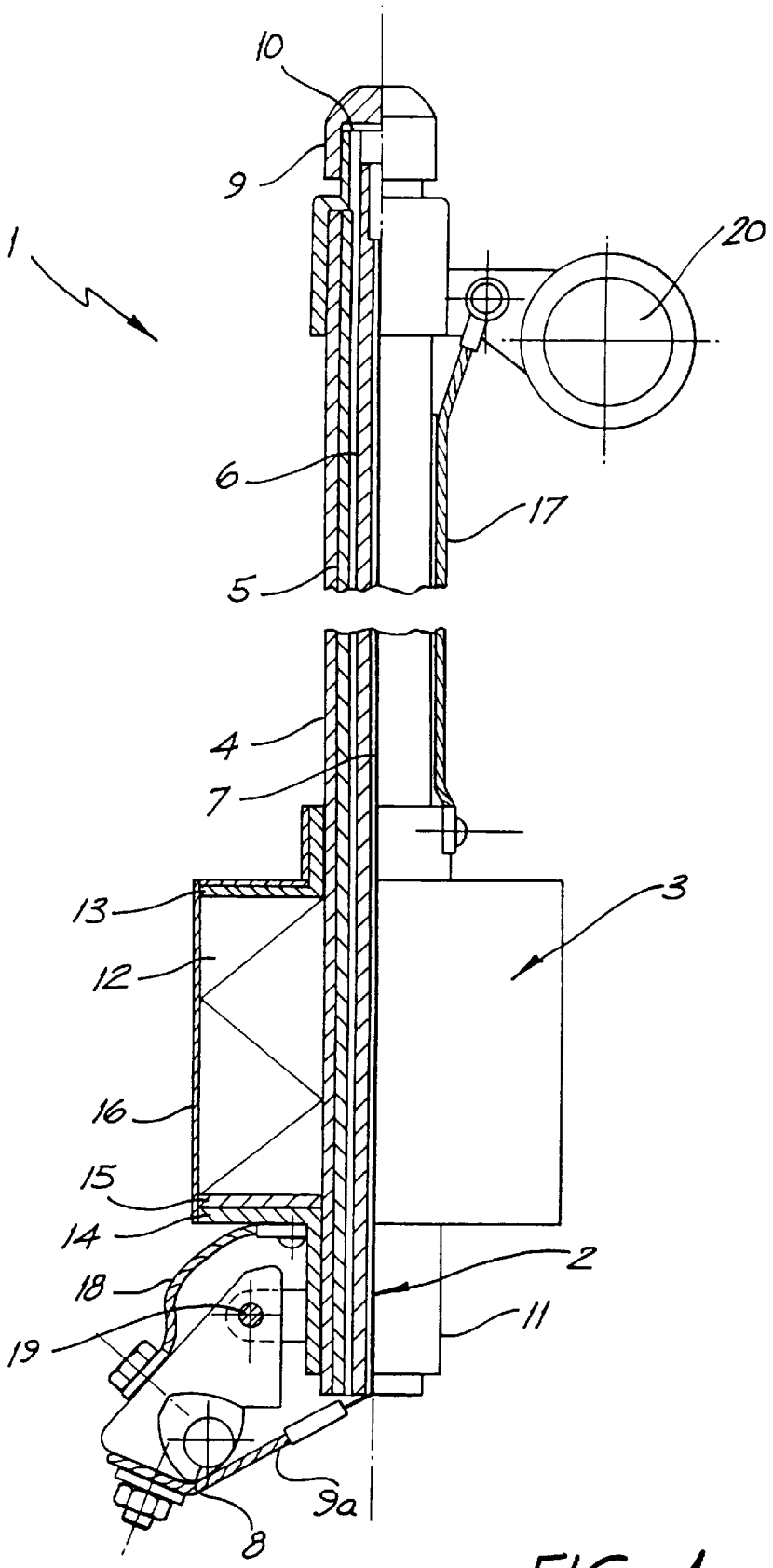
FIG. 1 is a partial cross-sectional view of a fuse arrangement in accordance with one embodiment of the present invention.

Referring to FIG. 1, a fuse arrangement in accordance with an embodiment of the present invention is indicated generally by reference numeral 1. The fuse arrangement comprises a fuse link, generally designated by reference numeral 2, and, in this embodiment, being an expulsion fuse, and an energy absorbing device designated generally by reference numeral 3 and in this embodiment being a zinc-oxide varistor.

The fuse arrangement is mounted with respect to a "dropout" type carrier, which is arranged to mechanically remove itself from the current carrying circuit following fuse operation, in a manner known in the art, in order to break the current carrying circuit.

In more detail, the arrangement comprises a fuse carrier 4, which is a mechanically strong tube. Mounted within the carrier 4 is a carrier liner 5 and narrow diameter auxiliary tube 6. The liner 5 and auxiliary tube 6 are made of ablative materials. Running within the auxiliary tube 6 is fuse element 7. Fuse element 7 is "deeply confined", by virtue of the fact that it runs within the narrow auxiliary tube 6, to enable it to generate the relatively high voltage required during operation for commutation of the current to the energy absorbing device 3. The Requirements for the production of the relatively high voltage are discussed later on in the specification.

The fuse element 7 is connected to a first fuse carrier contact 8 by a flexible tail 9*a*. The other end of the fuse element is connected to the other fuse carrier contact 9 by fuse element contact 10. The fuse-carrier lower contact 8 is free to move with respect to the lower fuse carrier cap 11 (as in known dropout fuses).

The energy absorbing device 3 is mounted on the tube 4. It comprises a zinc-oxide varistor 12 mounted between two conducting caps 13 and 14 by means of a spring washer 15. The outside surface is covered with an insulating sheath 16. This device 3 is electrically connected to the contacts 8 and 9 by cord conductors 17 and 18.

In operation, contacts 8 and 9 are connected in the current carrying circuit which is being protected by the fuse arrangement 1. On occurrence of a fault current, fuse element 7 disintegrates and at the same time develops a relatively high voltage across terminals of the varistor 12. After a very short period of time, therefore, the current initially flowing through fuse element 7 is commutated to the varistor 12, which operates to absorb the electrical energy associated with the fault current condition. At the same time, because fuse element 7 has broken, contact 8 pivots with respect to fuse carrier cap 11 on pivot 19 and the entire arrangement mechanically drops out of the circuit. The "drop out" operation is known in the art. Because the electrical energy associated with the fault has been absorbed by varistor 12, damage to circuit elements is avoided and it is not necessary to build the fuse link 2 with a capability to dissipate large energies. Varistor 12 is so efficient in absorbing energy that dropping out of the arrangement interrupts a circuit which already practically has no current, or possibly has a weak capacitive current.

Fuse arrangement 1 thus operates as a current limiting device and a current breaking device. Current limitation occurs because the fault current is commutated to the energy absorbing device 3 by virtue of the generation of a high voltage across the terminals of the energy absorbing device 3 on operation of the fuse link 2.

The arrangement can be designed to have very high breaking capacities to limit and break currents of 12 KA and more. The arrangement may also have a large operating range. At an insufficiently high value of fault current, however, the current switch over to the varistor may sometimes be incomplete and part of the current may still pass through the fuse, which must handle the associated arcing energy. For this reason, the fuse link 2 may be arranged to have the determined interrupting capacity for minimum value fault current, i.e., it should be arranged to operate like a normal expulsion fuse at the minimum value of fault current required. This will of course depend upon the requirements of the circuit. It may be possible to design an arrangement which works by commutative switch over for the entire operating range required by the circuit.

Figure 2:
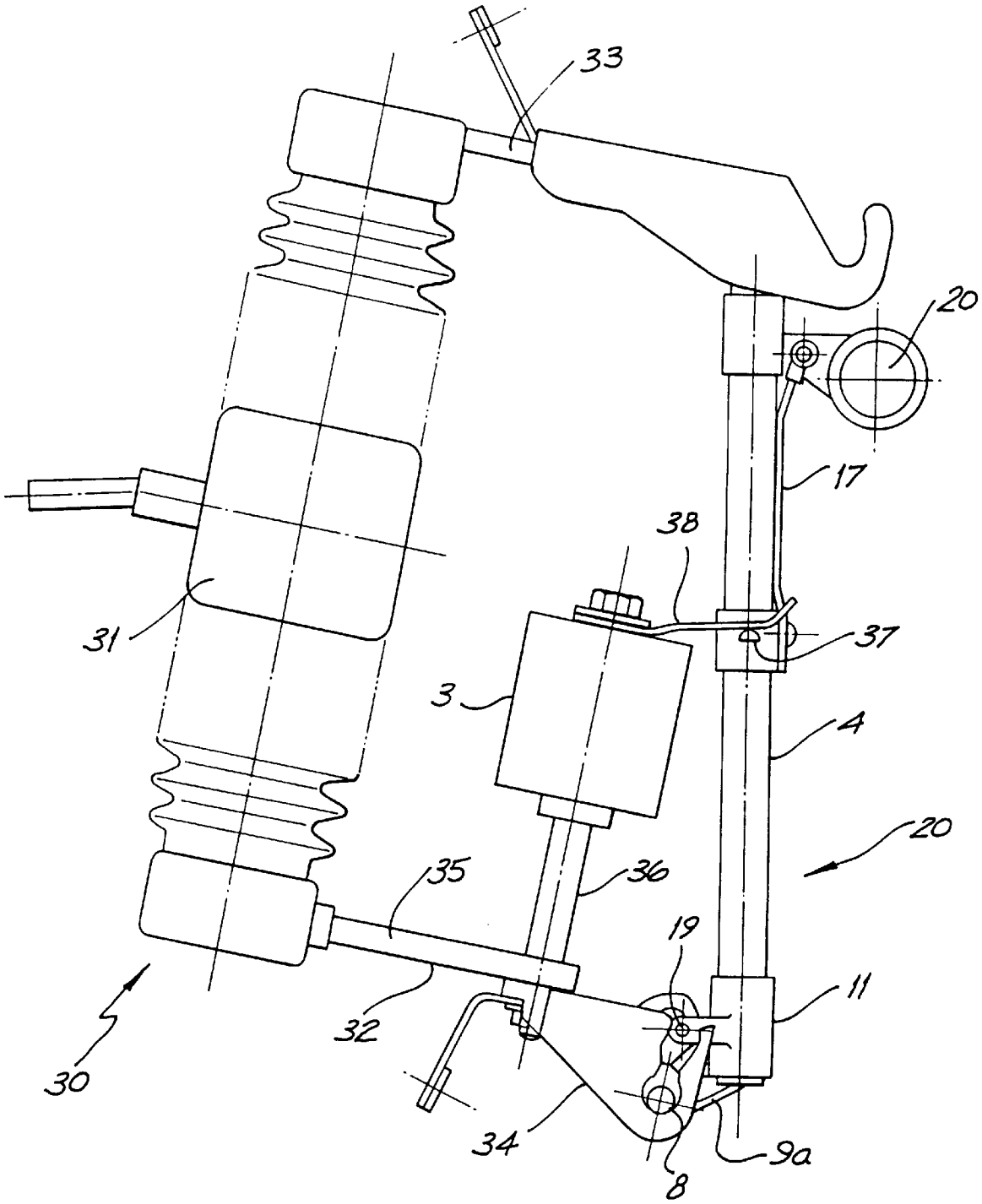
FIG. 2 is a side view of a fuse arrangement in accordance with a further embodiment of the present invention.
Figure 3:
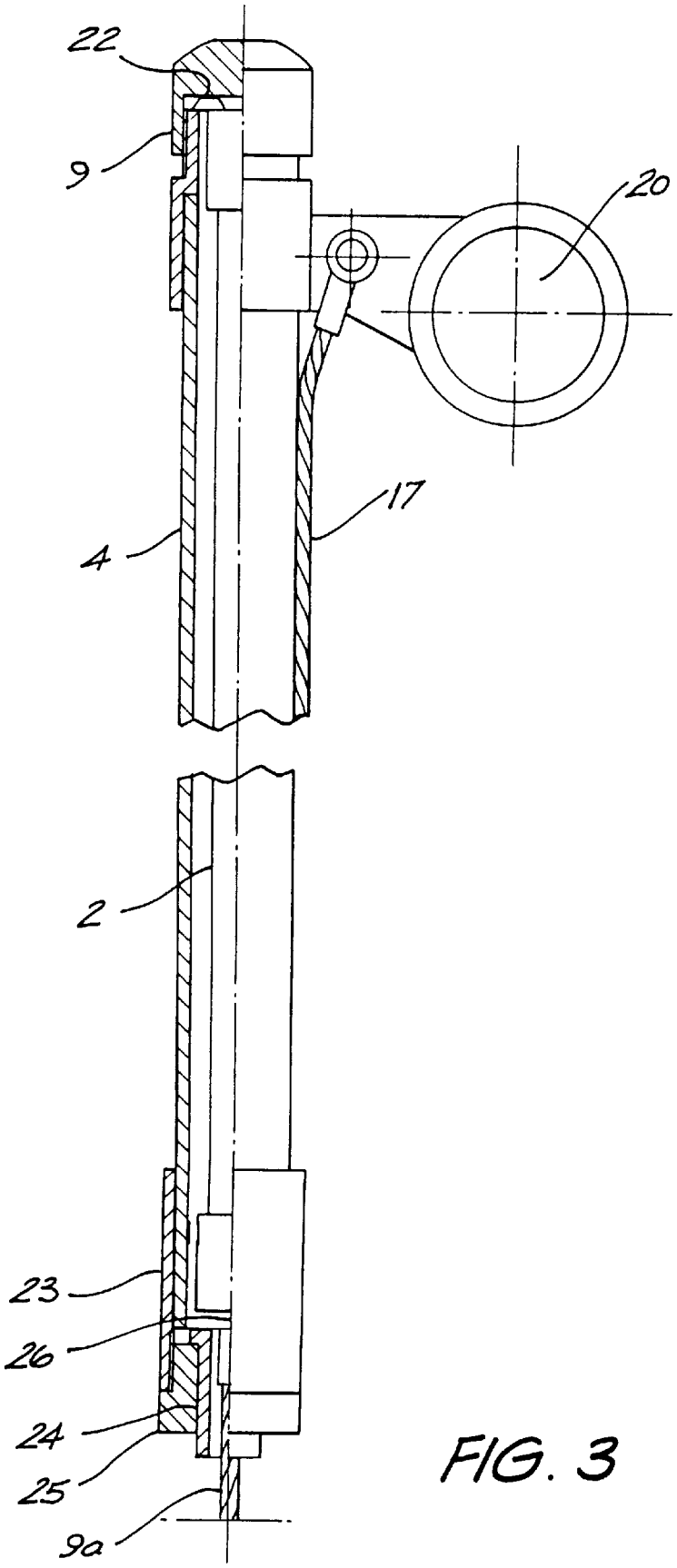
FIG. 3 is a partial cross-sectional view of a portion of the fuse arrangement of FIG. 2.

FIGS. 2 and 3 show an alternative fuse arrangement generally designated by reference numeral 20. In FIGS. 2 and 3, the same reference numerals have been used to designate components which are the same as the components already discussed in FIG. 1. No further description of these components will be given.

The structure of the arrangement is slightly different from that of FIG. 1. The fuse carrying tube 4 carries a compact sand fuse, arranged to develop a high voltage at its terminals on operation. The sand fuse 2 is terminated at its top end with button contact 22. At its lower end it is connected to flexible tail 9*a,* which is insulated from the lower cap 23 by insulating sleeve 24 held in by tightening screw 25. The portion of the fuse element 26 of sand fuse 2 is connected at the lower end of the fuse link 2 to the flexible tail 9*a*.

Referring to FIG. 2, fuse carrier 4 with fuse link 2 is shown mounted with respect to a standard fuse base arrangement, generally designated by a reference numeral 30, of the type normally used in high voltage/high current arrangements such as electrical distribution networks. The fuse base arrangement 30 comprises an insulator 31 and terminals 32 and 33 for connecting to the respective terminals 8 and 9 of the fuse arrangement. Terminal 32 and 33 will carry electric current from the electric current carrying circuit being protected by the fuse arrangement. Terminals 32 comprises a lower fuse base contact 34 and metal rod 35.

The energy absorbing device 3, which has the same structure as the energy absorbing device shown in FIG. 1, is not mounted on fuse carrier 4 but is mounted on rod 35 by means of conductive rod 36. The opposite terminal of the energy absorbing device 3 is connected to intermediate contact 37 by means of contact 38 and is connected to the upper contact 9 by means of the conductive cord 17.

In operation, on the occurrence of a fault current, fuse element 26 fuses and the fault current is commutated through energy absorbing device 3 preventing large amounts of energy dissipation in the fuse 2 and preventing damage to the electrical circuit. At the same time, because fuse element 26 is broken, terminal 8, which is normally under tension, springs back and the fuse carrier pivots. At the same time intermediate contact 37 disengages from terminal 38, breaking the current carrying circuit.

For higher voltage applications it may be necessary to extend the length of the fuse link shown in FIG. 1 or FIG. 2. Referring to the FIG. 2 arrangement, this can conveniently be done by extending the length of the tube 4 beyond the terminal 20, the fuse element being taken from the end of the extended tube and run backwards over a portion of the extended tube to connect with the terminal 20. The entire tube arrangement 4 extends past the terminal 20.

In an alternative embodiment, where the fuse arrangement is mounted in the metal or plastics enclosed switch gear in indoor or pad mounted substations, the fuse arrangement is incorporated with a mechanical triggering device designed to operate the load break switch. Such mechanical triggering devices are known.

Figure 4:
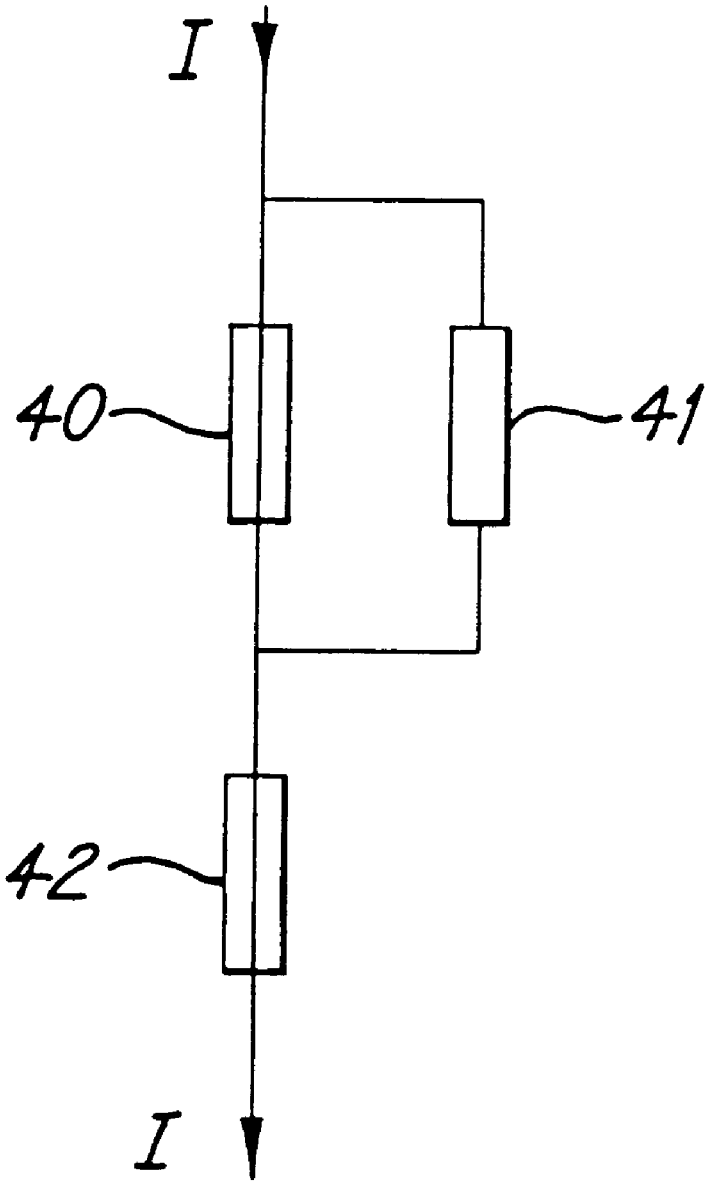
FIG. 4 is a circuit diagram for a fuse arrangement in accordance with a further embodiment of the present invention.

A further alternative embodiment is shown schematically in FIG. 4. In this arrangement, the fuse link 40/resistor 41 arrangement are not arranged to physically drop out of the circuit on fuse operation. Instead, they are connected in series to a circuit breaking fuse 42 which may be a normal expulsion fuse with appropriate parameters for fuse operation.

In operation, on occurrence of a fault current, fuse link 40 generates a high voltage to commutate current to energy absorbing device 41. Because of the operation of commutating fuse 40 and fuse arrangement 42, current due to the fault is limited and can easily be handled by the current breaking fuse 42, which operates to break the current in the current carrying circuit. A high value resistor may be used instead of a varistor for energy absorbing device 41.

It will be appreciated that the operating parameters of the fuse link and energy absorbing device will vary depending upon the application. The major requirement for an operation of the fuse arrangement in accordance with the present invention is that the fuse operates to generate a high enough voltage on occurrence of a fault current to commutate the current into the energy absorbing device. The actual value of this voltage which it is necessary to generate will vary on application and depending upon the energy absorbing device. We have performed experiments with expulsion fuses to establish constructions for use with the present invention for operation in high voltage/high current environments such as would be experienced by fuses used in electrical distribution systems. Some results of these experiments are discussed in the following.

The main requirement for the fuse link is rapid current commutation from the fuse link to the energy absorbing device (e.g. varistor). This depends mainly on the fuse ability to produce a voltage higher than the varistor voltage level in a time as short as possible.

The best moment for commutation is at the instant of arc ignition in the fuse link. The amount of energy dissipated in the fuse link is at its smallest value, and it is unnecessary for the fuse link to have any high energy-handling capacity. It can be light weight and cheap. Designs based on drop-out expulsion fuses are very suitable for this task, since they achieve a high dielectric withstand independently of the fuse element holder.

For simplicity, only fuse models with cylindrical channels have been used:

The basic model was made from fibreglass tubing, 15 cm or 20 cm long, lined with a PTFE tube, 3.4 mm in inner diameter, into which smaller ablative tubes were inserted. Their inner diameters were in the range of 0.75–2 mm. A close fitting was applied. Both ends of the fuse were open.

Additional models were made from commercially available expulsion drop out fuses 11 kV, 100 A, 33 cm long. The carriers were drilled and lined with a layer consisting of aluminium, oxygen, carbon and hydrogen, called Al—O—C—H. Their inner diameters were of 4.3 mm and 20 mm. They were considered as large chambers.

In most tests, cylindrical, copper fuse elements were used and their cross-section areas were in the range of 0.03–0.6 $mm^2$.

All tests were carried out in a synthetic, oscillatory test circuit with the capacitor bank charged to 6 kV. In the tests of the current commutation parallel varistors of 6.5 kV, or 13 kV, 10 kA were connected. In other cases, the tested fuses were de-energised in a half of a millisecond after the ignition peak by closing a parallel switch. Prospective currents of 400–12000 A (eff.) were used.

Figure 5:
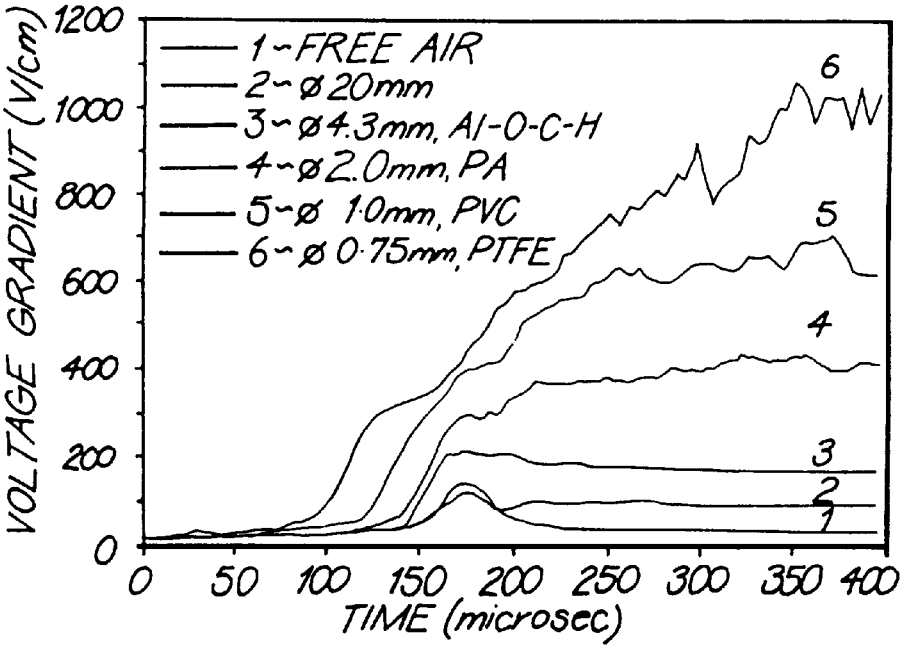
FIG. 5 is a plot of voltage gradient against time for a series of expulsion fuses under a variety of confinement conditions.

Some tests have been carried out to determine conditions for high fuse arc power and to investigate the arc ignition process in a capillary chamber. The results are presented in FIGS. 5 and 6. The following observations can be made:

FIG. 5 shows the arc ignition voltage gradient in various cylindrical, ablative chambers and for free arc for the prospective current of 2.2 kA, for which copper fuse elements, 0.36 mm in diameter were used. It is evident that the walls significantly influence the arc ignition process, although the arc development time is too short (several tens of micro-seconds) to expect any significant axial convection flow to contribute to the overall arc energy balance.

Initially, the voltage rises steadily for each of the confinement systems, with a rate of rise very similar for most chambers. Only the free arc and very large chamber (Ø20 mm) curve slopes are "soft". This period is called the "initial" period of arc ignition.

After approximately 50 $\mu$sec, a new arc development pattern can be noticed. The arc voltage keeps rising, but more slowly. For larger channels, the voltage maintains its value, or even decreases if the diameter is very large. Evidently, a new mechanism begins to play a role. This can be called the "late" period of arc ignition. The critical voltage and time depend on the chamber diameter, the fusing current and the fuse element cross-section. In the narrowest chamber tested, ((Ø0.75 mm) the voltage keeps rising over several hundreds of microseconds reaching a value of approximately 1 kV/cm.

Figure 6:
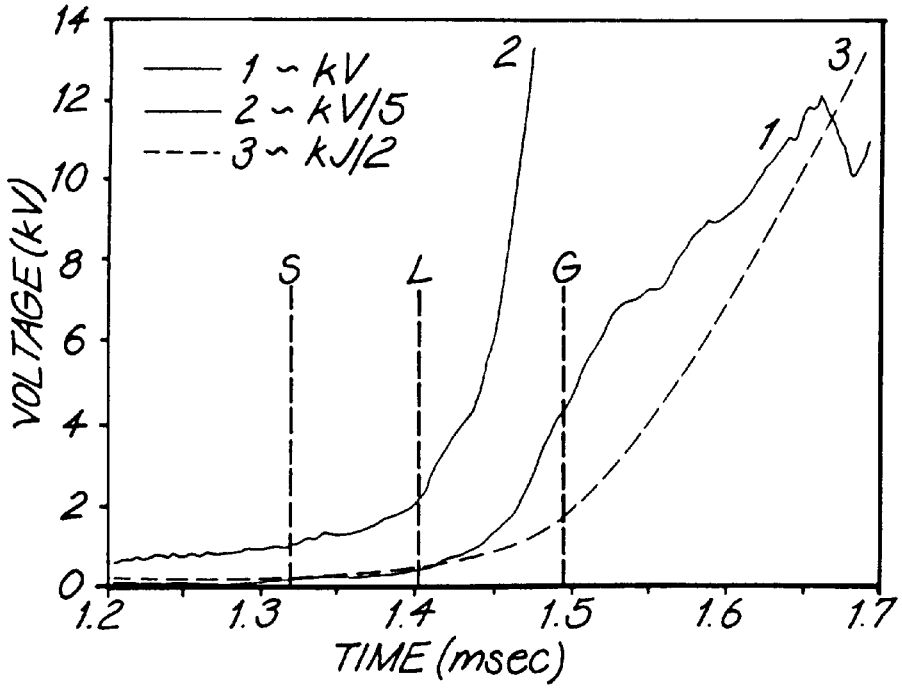
FIG. 6 is a plot of voltage against time illustrating an arc ignition voltage curve in a PTFE chamber, 0.8 mm in diameter for a prospective current of 2.2 kA.

In FIG. 6, an arc ignition voltage curve in the PTFE chamber, 0.8 mm in diameter, is presented (1) for the prospective current of 2.2 KA (eff.). It is accompanied by the arc energy curve (3) and a curve (2) being a reproduction of the curve (1) with the scale multiplier of 5. The energy limits of the fuse element state transition under normal pressure are shown. S, L, $G_{min}$ indicate correspondingly: S—the melting point, L— the boiling point, and $G_{min}$—the fuse element vaporisation enthalpy under normal pressure. Both the voltage drop and the energy were taken into account when the limitations were determined. The material data given by Rex (Rex G. H., Calculation of models for adiabatic processes, Int. Cont. on Electric Fuses and Their Appl., Trondheih (Norway), June 1984, pp. 35–51.) and Samsonov (Samsonov G. V., Handbook of the physicochemical properties of the elements, IFI/Plenum, New York 1968.) was used.

It is clear, therefore, that the diameter of the tube in which the fuse element is held does have an effect on the initial generation of voltage at ignition of the fuse element. From further experiments, however, we found that of more importance are material characteristics of the fuse element itself.

Some further experimentation has also been carried out into the behaviour of fuse arrangements in accordance with the present invention comprising varistors in parallel with the fuse link. The following discussions relates to arrangements used for high voltage/high current applications and may assist in fuse arrangement design.

Figure 7:
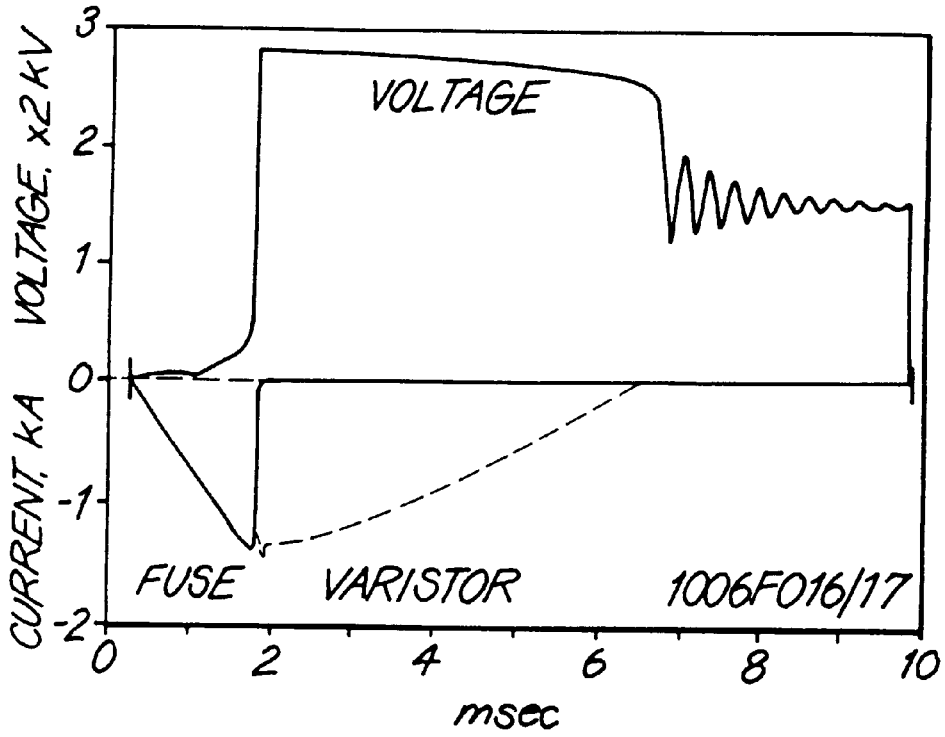
FIG. 7 is a plot of voltage and current against time for operation of a fuse/varistor arrangement in accordance with an embodiment of the present invention.

The present authors have been investigating the commutation conditions in expulsion fuse-varistor arrangements using a 6-kV, synthetic, oscillatory test circuit. Varistor blocks of 6 kV taken from 72 kV, 10 kA surge arresters, have been used. In most cases, the commutation process requires of the order of several tens of micro-seconds only of arcing. A typical record is presented in FIG. 7.

The test current has a prospective value of 2.2 kA rms and is limited essentially to the fuse element melting value by arc current commutation onto the parallel connected 6-kV varistor. After commutation the current is forced smoothly to zero and at a time far earlier than the natural current zero. The fuse current flows within the expulsion carrier for about 100 micro-seconds. only.

To make the arrangement interesting commercially the fuse link used should be small and of simple construction. This requires an ability to generate very high voltages from a "short" fuse element. Using the methods described here, values of 400–700 V/cm have been achieved.

Figure 8:
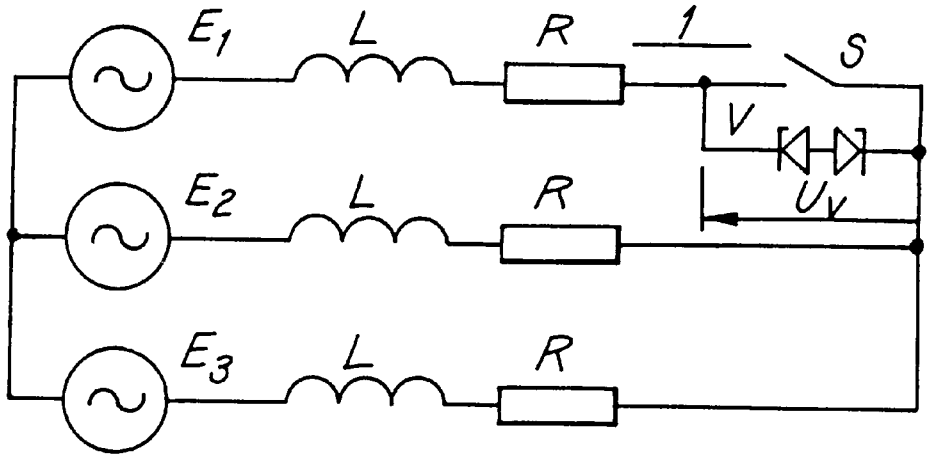
FIG. 8 is a circuit diagram of a three-phase circuit used in experimental analysis of a fuse/varistor arrangement in accordance with an embodiment of the present invention.

To analyse the fuse-varistor arrangement, the 3-phase circuit with the unearthed neutral point presented in FIG. 8 has been used. The operating fuse link is shown schematically by a simple switch S. Even long connecting cables to the varistor did not affect significantly the speed of this process. The parallel varistor V maintains a constant voltage value until current zero, as the U-I profile of a ZnO block can be considered almost rectangular (Lat M. V., "Analytical method for performance prediction of metal oxide surge arresters", IEEE Trans., vol. PAS-104, No. 10, October 1985, pp. 2665–74). The electromotive force in the operating phase is cosinusoidal to obtain a symmetrical current in an inductive circuit. Under these conditions, the commutation current in the phase with the first operating fuse (in the range between the fusing instant $t_f$ and the current zero $t_z$) is given by:

$$i = I_p\left[\cos(\omega t - \psi - \phi) - \cos(\psi + \phi)\exp\left(-\frac{1}{T}\right)\right] - \frac{U_v}{1.5R}\left[1 - \exp\left(-\frac{t - t_f}{T}\right)\right], \quad (1)$$

where $\psi$ is the circuit making angle, $\cos\phi$ the power factor, and $I_p$ the amplitude of symmetric, prospective short-circuit current. This equation enables calculation of varistor parameters for known conditions, but still it is not easy to predict: behaviour of the arrangement. A few simplifications and observations are needed.

The first segment of equation (1) represents the short-circuit current, and the second, a component resulting from the varistor voltage. The factor of 1.5 in the denominator of equation (1) is the phase factor for an ungrounded 3-phase short circuit.

For low power factor (PF), $$I_p = \frac{E}{\omega L}.$$

The exponential term can be substituted by a linear rise of current.

Equation (1) can be approximated by:

$$i = I_p\left\{\left[\sin(\omega t - \psi) + \sin(\psi)\exp\left(-\frac{1}{T}\right)\right] - \omega\frac{U_v}{E}(t - t_f)\right\} \quad (2)$$

Figure 9:
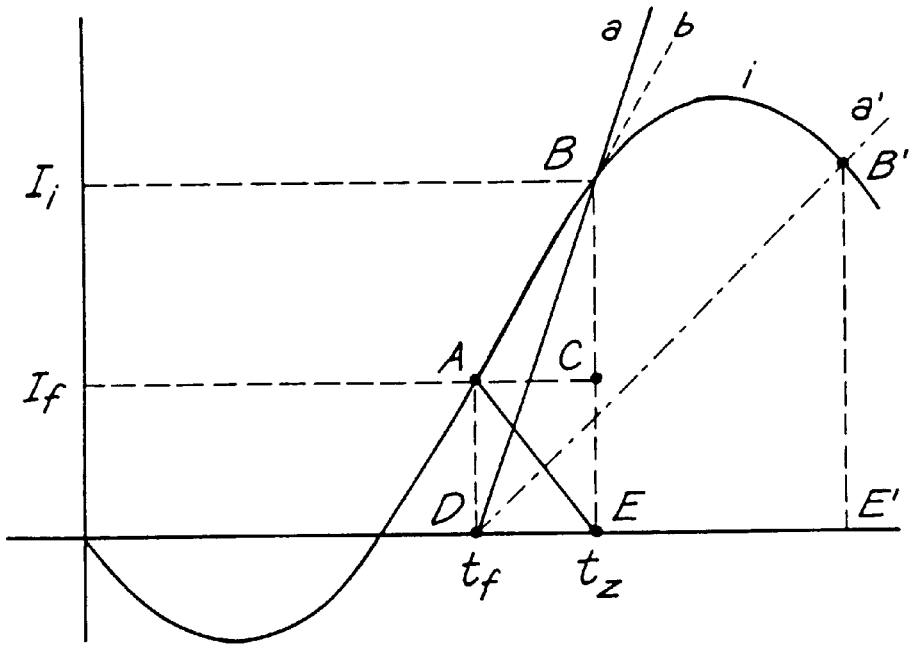
FIG. 9 is a plot for obtaining normalised terms for an equation for calculating commutation current in the range between fusing instant and current zero.

The current i can be now normalised in respect to $I_p$. Its profile depends essentially on $U_v/E$. FIG. 9 gives normalised terms of equation (2).

The energy of interruption process $A_c$, accumulated mainly in the varistor, is given by the integral:

$$A_c = U_v\int_{t_f}^{t_z} i\,dt = f\left(\frac{U_v}{E}, I_p, t_f, PF, \psi\right) \quad (3)$$

From FIG. 3

$$A_c = \frac{1}{2}U_v(I_p \cdot I_f)\cdot(t_z - t_f), \quad (4)$$

$$I_i = I_f + I'_f(t_z - t_f) = \omega\frac{U_v}{E}(t_z - t_f), \quad (5)$$

where $I_f$ is the normalised fusing current and $I_f$ is the short circuit normalised derivative at the instant of fuse element melting. The application of these relations, results in $$A_c = \frac{U_v}{2}\frac{I_f^2}{\omega(U_v/E) - I'_f}I_p \quad (6)$$

It can be seen that an increase in varistor voltage leads to a decrease in the energy $A_c$ with a limiting value of $A_{inf}$:

$$A_\infty = \frac{1}{2}\frac{E}{\omega}I_f^2 I_p, \quad (7)$$

which represents the energy of the magnetic field due to the fusing current ($I_f I_p$).

$$A_\infty = \frac{1}{2}(I_f I_p)\frac{EL}{\omega L}I_f = \frac{1}{2}(I_f I_p)^2 L = A_{ind}. \quad (8)$$

Using this term as a normalising factor, the interrupting process energy is given by:

$$A_c = A_{ind}\frac{U_v/E}{(U_v/E) - (I_f/\omega)}$$

Equation (9) demonstrates that:

The energy involved in the current switching process by means of the fuse-varistor arrangement is always higher than the magnetic field energy at the instant of the fuse operation, because the denominator is always smaller than $U_v/E$ (energy from source is taken until current changes direction).

The higher the varistor voltage level, the smaller is the accumulated energy. The lower limit is the magnetic field energy at the instant of fusing.

The critical condition occurs when $U_v/E$ does not differ much from the rate of rise of the short-circuit current normalised derivative before melting the fuse element divided by the angle frequency.

There is a strong influence of the fuse element cross-section on varistor dimensioning, for both the fusing current and its derivative depend on this value.

It should be stressed that equation (9) is an approximation and, in reality, there is no discontinuity, because the line a in FIG. 3 always intersects the curve of fault current i. In such a case the energy proportional to the area ABB'E'D-DB'E' can be several times higher than that proportional to AED. For this reason, corrective coefficients should be introduced both to the numerator and denominator of the equation to correct the time $t_z$ and shape of the line a different in reality from the straight one. Some limitations of application of this equation should be also observed.

$$A_c = A_{ind}\frac{K_1(U_v/E)}{(U_v/E)-(K_2/\omega)I'_f} \tag{10}$$

From (7) it can be demonstrated that the energy of the magnetic field in the interrupting phase at the instant of fusion is equal to:

$$A_{ind} = \frac{1}{\omega}P_p I_f^2 \tag{11}$$

where $$P_p = \frac{Ei_p}{\sqrt{2}\sqrt{2}} = I_p\frac{E}{2}$$

is the single phase short-circuit power. Therefore the energy $A_c$ depends strongly on a fuse element cross-section and circuit parameters, as both $I_f$ and $I_f'$ result from these values. Short-circuit power influences proportionally to $A_c$.

Varistor Dimensioning

From a practical point of view, it is important to establish certain rules for varistor dimensioning. These have been based on a graphical representation of $A_c$ as a function of the fuse element cross section $S_f$, prospective current $I_p$, circuit power factor and making angle ψ.

Figure 10:
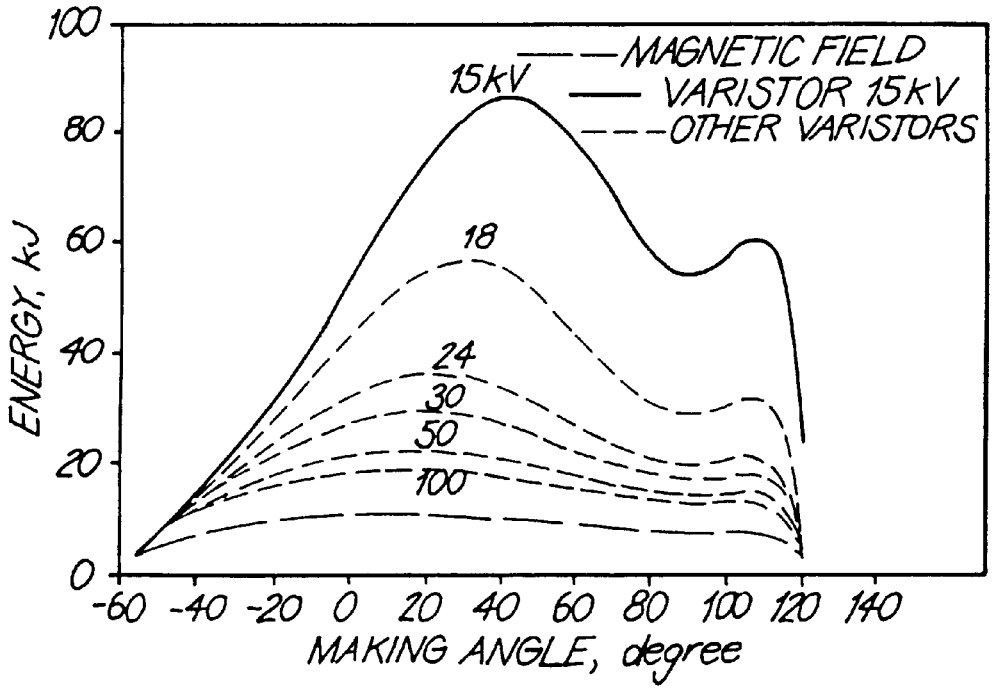
FIG. 10 is a plot showing varistor absorbed energy as a function of fault making angle for a range of varistor commutation voltages for an arrangement in accordance with an embodiment of the present invention.
Figure 11:
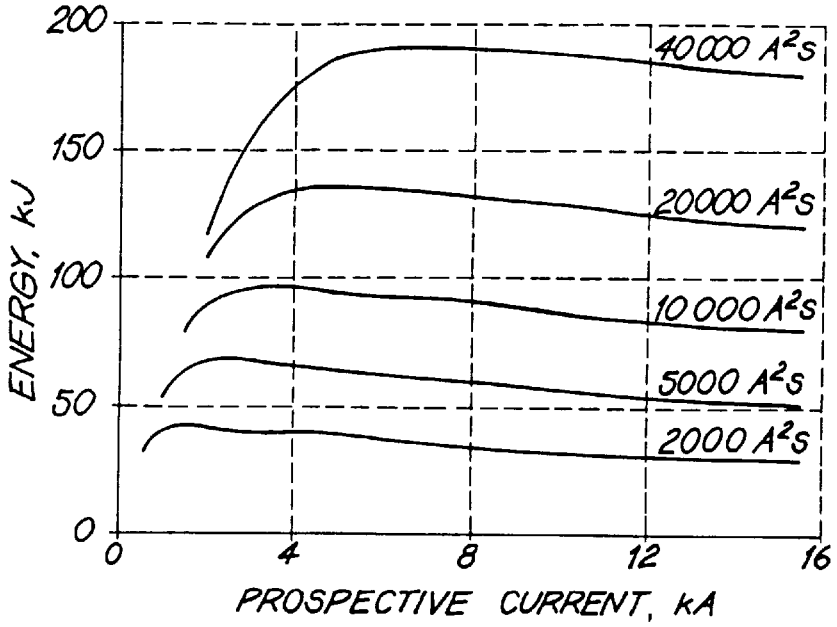
FIG. 11 shows a plot of fuse energy as a function of prospective current for a range of fuse element short circuit parameter values for an arrangement in accordance with an embodiment of the present invention.
Figure 12:
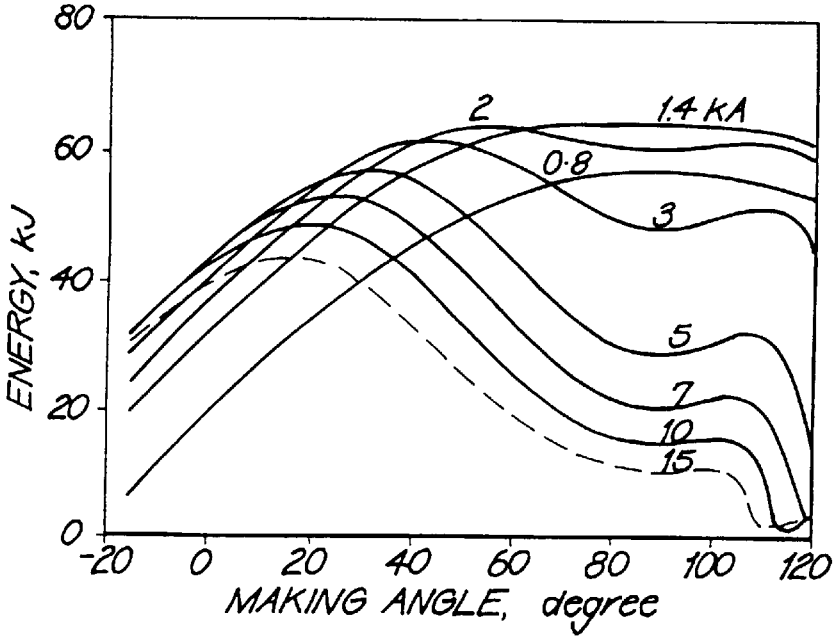
FIG. 12 is a plot of varistor absorbed energy as a function of making angle for a selection of prospective currents for arrangements in accordance with embodiments of the present invention, ("prospective" indicates the current or voltage that would be obtained in the absence of a fuse and under "ideal" conditions)
Figure 13:
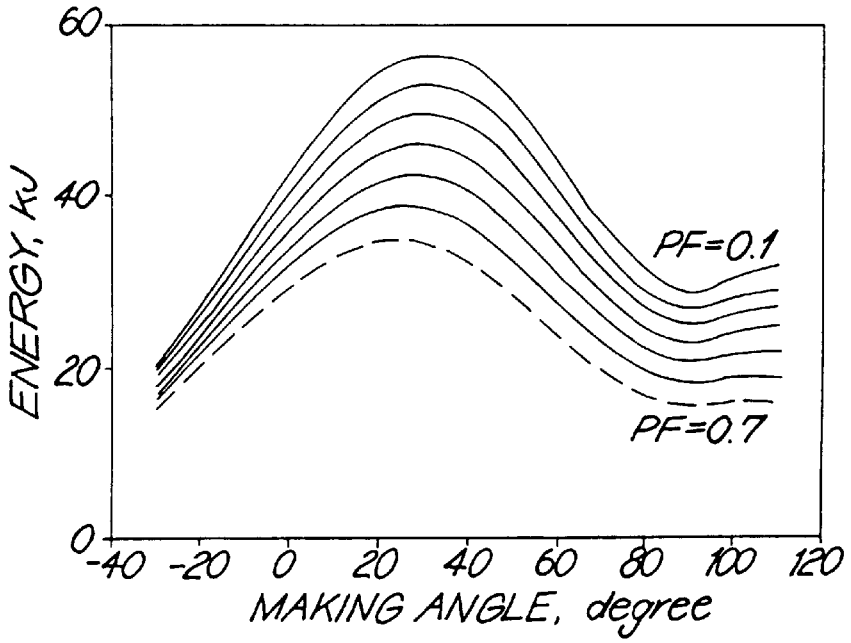
FIG. 13 is a plot of varistor absorbed energy as a function of making angle for a range of power factor values for a arrangements in accordance with embodiments of the present invention.

Some results are presented in FIGS. 10 to 13 showing the influence of various parameters on energy dissipation. FIG. 10 demonstrates the effect on dissipated energy of the making angle for a range of varistor voltages. The circuit conditions in FIG. 10 are: E=11 kV, 3-phase circuit, PF=0.1, $S_f$=2000 $A^2$s, $I_p$=5 kA,. Clearly the higher the varistor commutation voltage the lower the total energy dissipated in the varistor. FIG. 11 shows fuse energy as a function of prospective current for a range of joule integral values. For FIG. 11 the conditions are: E=11 kV, $U_v$=18 kV. FIG. 12 shows the effect of fuse element cross-section, with E=11/$(3)^{1/2}$ kV, $U_v$=12 kV, while FIG. 13 gives similar results as a function of circuit power factor, PF with E=11/$(3)^{1/2}$ kV, $U_v$=12 kV.

FIGS. 11 and 12 show that, for a given fuse element cross-section, the energy $A_c$ has a maximum at some values of prospective current and circuit parameters. This indicates that the fuse-varistor arrangement possesses unlimited breaking capacity at high short-circuit currents. Further prospective current increase makes the interruption process easier.

It is worth noting that:

The maximum of energy $A_c$ for all curves in FIG. 12 occurs for the same value of $S_f/I_{p2}$~0.0005, when $U_v$/E>1.33.

This maximum normalised by $\sqrt{S_f}$ has the same value for all fuse element cross-sections, when other parameters are constant.

Figure 14:
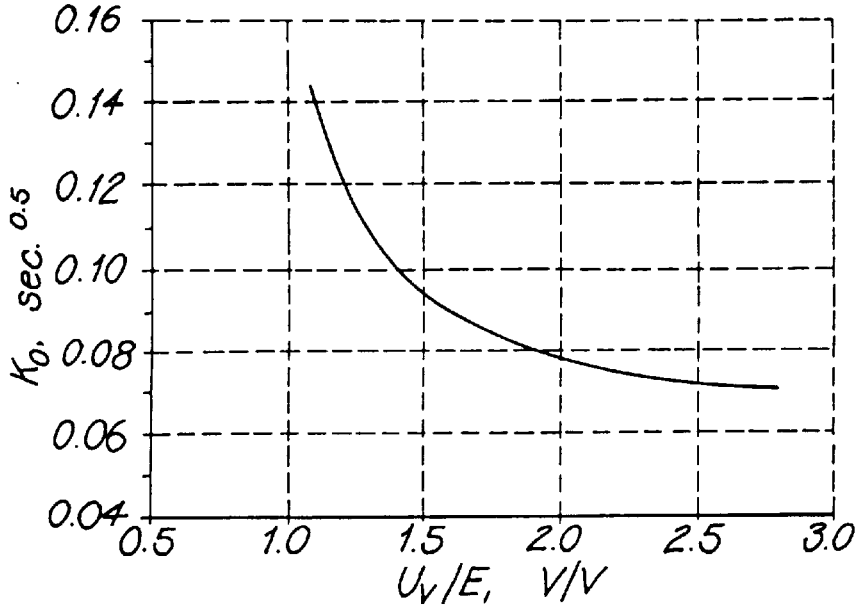
FIG. 14 is a plot of energy coefficient $K_a$ as a function of arc voltage ratio.

For maximum $A_c$ condition, in the denominator of equation (10), the value of $$\frac{K_2}{\omega}I'_f - 0.72 - I_f$$

the term:

This provides essential information for dimensioning of the varistor because its volume depends on the energy absorbed. The equation for maximum energy $A_{cmax}$ is:

$$A_{cmax} = 0.05E\frac{(U_v/E)}{(U_v/E)-0.72}\sqrt{S_f} = K_a E\sqrt{S_f}\text{, kJ} \tag{12}$$

where E and $U_v$ in kV (peak value), and $S_f$ in $A^2$S. In 3-phase circuits E represents the phase voltage after interruption. Therefore the symmetrical phase voltage multiplied by the coefficient 1.3 to 1.5 depending on the neutral point connection, should be used. The coefficient $K_a$ vs $U_v$/E is plotted in FIG. 14.

It should be stressed that the conditions of operation of the varistor in the fuse-varistor arrangement are quite different from those that occur when the varistor is used as overvoltage protection. In the latter case, the varistor thermal stability is crucial because it is maintained under the constant operating voltage.

For the expulsion drop-out application, voltage appears across the varistor from the moment of arc ignition until the drop-out action has disconnected the fuse carrier from the base. For this reason, dimensioning of the varistor component can rely on one-shot capacity, which is several times higher, [8 ] than for over voltage protection applications. In general, a temperature rise, even to 200° C., is not believed to be dangerous if the varistor is properly shielded from touching.

Varistor Voltage

When selecting the varistor voltage, the following observations can be taken into account:

The varistor voltage plays an essential role in moulding fuse-varistor arrangement features. The higher this voltage, the smaller the amount of energy involved in the current interruption process and the less can be the volume of the varistor. However, this is in opposition to the fuse requirements because, in this case, the length of the fuse must increase.

The $A_c$=f($U_v$) relationship is almost hyperbolic. Therefore, there is no reason to select very high or very low $U_v$. In the first case, there are problems with the fuse. In the other, the varistor must be very large. An optimum $U_v$/E close to 1.5 could be recommended.

The varistor voltage controls switching overvoltages generated by the fuse-varistor arrangement. The lower this voltage, the better conditions for insulation of protected equipment. Taking into account the current limiting abilities of the arrangement, the level 1.5 suggested above seems to be satisfactory.

Testing Conditions

The most severe conditions of operation must be identified for the purpose of testing. In the case of varistors, conditions are important for the maximum energy occurrence.

$$I_{crit} = A\left(1+\frac{B}{(U_v/E)-C}\right)\sqrt{S_f} = K_{crit}\sqrt{S_f}. \tag{13}$$

Figure 15:
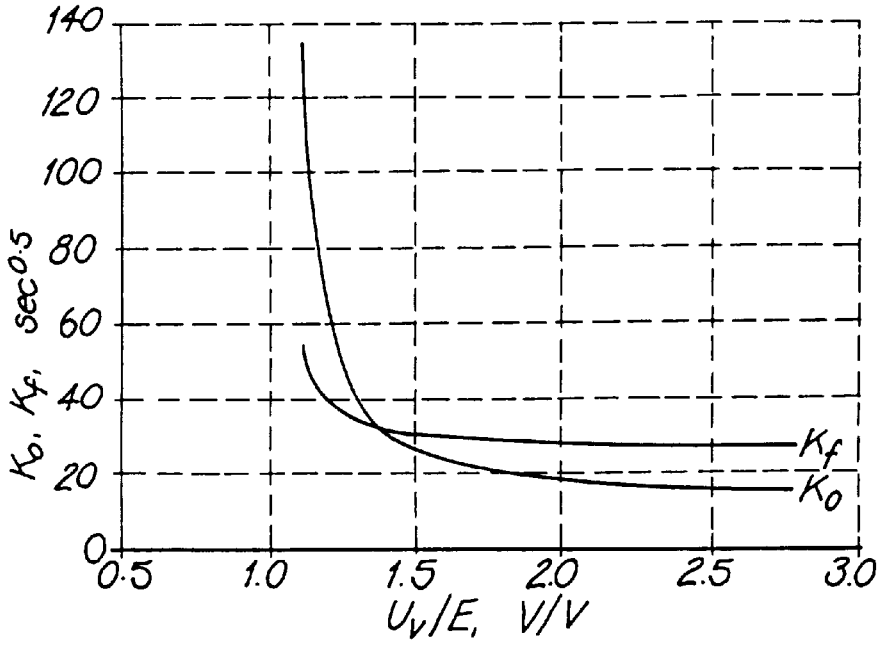
FIG. 15 is a plot of the coefficients $K_{crit}$ and $K_f$ as a function of arc voltage ratio.

FIG. 15 provides plots of $K_{crit}$ coefficients:

$$I_p = K_p\sqrt{S_f},\ I_f = K_f\sqrt{S_f}\text{, kA,} \tag{14}$$

Figure 16:
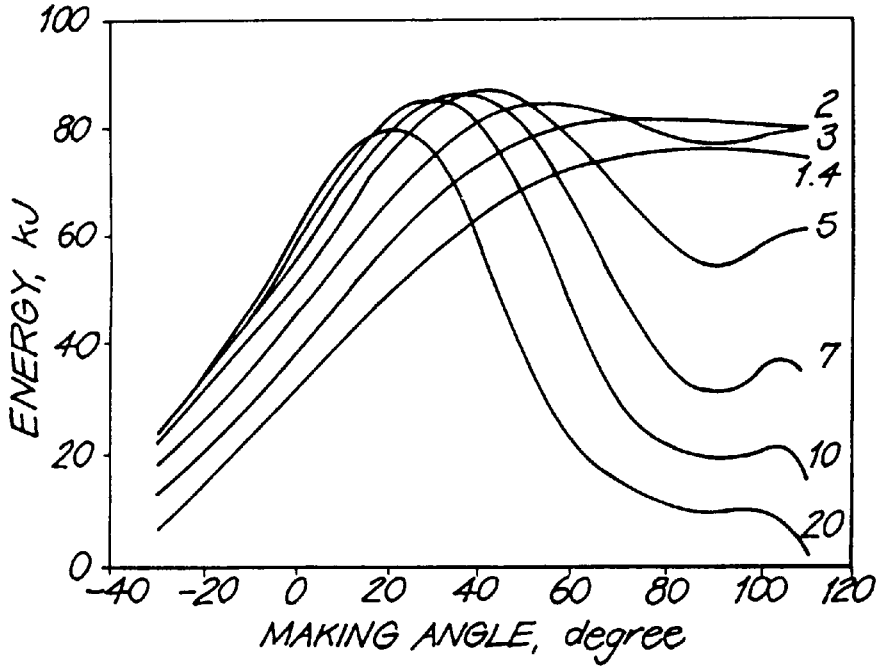
FIG. 16 is a plot of fuse energy as a function of making angle for a selection of prospective short-circuit currents for arrangements in accordance with embodiments of the present invention.

In the case of making angle ψ, the maximum energy is observed for ψ close to 90 degrees (FIG. 4). Only for $U_v$/E approaching 1, ψ shifts to smaller values (FIG. 16). This relation can be presented by the following approximating equation:

$$\psi = 30\left[1 + 2\tanh\left(\frac{A}{(U_v/E) - B}\right)\right], \quad ° \tag{15}$$

Conclusions

For short-circuit interruption using a fuse varistor combination there is a maximum energy generated which is a function of the prospective current, the making angle and the fuse element cross-section for a given varistor voltage.

The varistor voltage plays a crucial role in the shaping of the arrangement features. When the varistor voltage is close to the system voltage, energy is dissipated at a high rate requiring varistors of large volume. However, in this case the fuse elements are short, and the switching overvoltage is low. High values for varistor voltage reduce energy dissipation, but increase the fuse length.

The fuse element cross-section, which determines fuse current ratings, influences the varistor volume in a square root manner.

For drop-out fuses, the varistor volume should be evaluated in accordance with one-shot thermal capacity rather than thermal stability.

Figure 17:
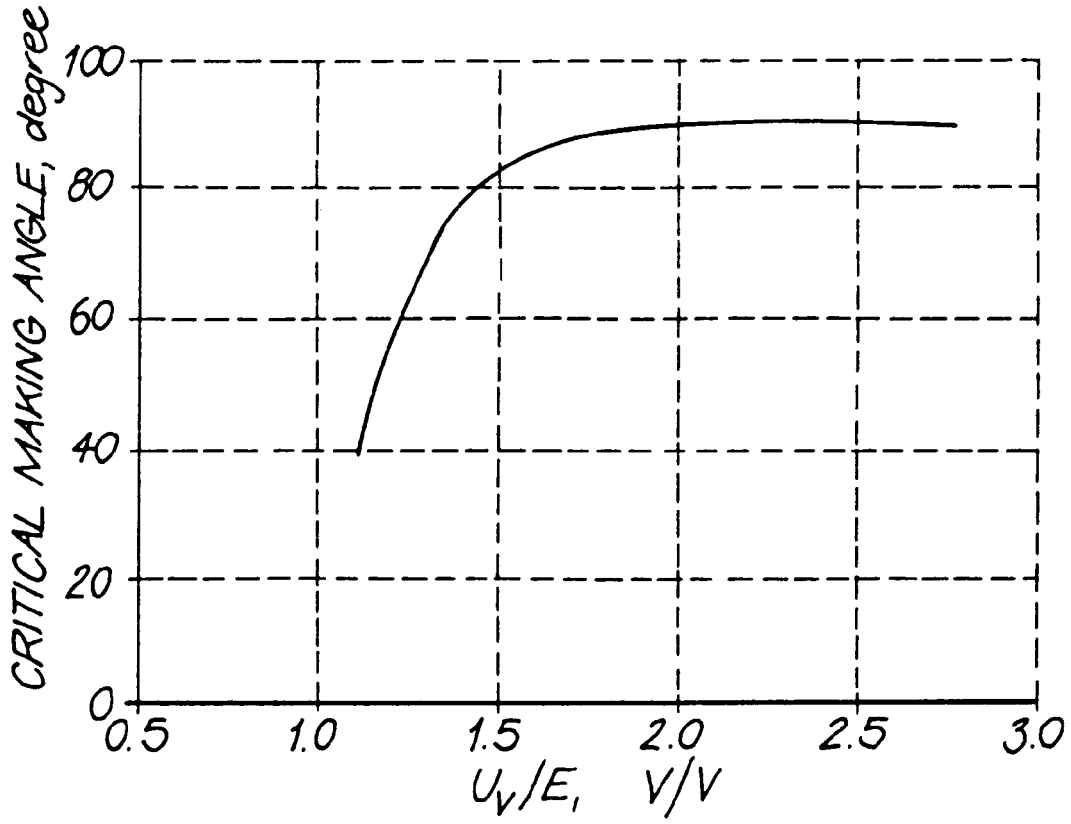
FIG. 17 is a plot of critical making angle as a function of arc voltage ratio.

The coefficients are given in FIG. 17 and have been calculated for $U_v/E>1.1$. Below this limit, the rules given cannot be applied. When $U_v/E$ decreases the energy maximum, $A_{cmax}$ shifts initially towards higher prospective currents and smaller making angles (demonstrated in FIG. 16), then disappears, and the $A_c$ increases always if $I_p$ rises. In such a case, individual calculation based on the general equations (1), (3) must be done. In the case of an expulsion fuse, the maximum arc energy depends on the fuse interrupting features and the fusing current and need not correspond with the maximum energy absorbed by the whole arrangement.

Fuses used in the arrangement must generate a voltage higher than the varistor level over the broad range of currents. Only small overcurrents should be broken without commutation and varistor assistance.

The fuse-varistor arrangement possesses excellent switching capabilities, such as current limitation, unlimited breaking capacity and controlled switching overvoltage level, when ideal fuse operation is considered. Application of expulsion fuses brings about a full range operation for any voltage and low cost of fault clearing.

Switching performance has been achieved at 24 kV with test currents at 65 A, 100 A, 4,000 A and 13,000 A. This switching performance was achieved with essentially negligible explosive effects by comparison with those which would be obtained with conventional expulsion fuses. Furthermore, testing to compare the emission of incandescent electrical sparks has shown that for these test conditions no emissions were obtained compared with copious emissions with conventional fuses.

It should be noted that we have also found using varistors of present design that multiple varistor blocks are only effective in the present arrangement when connected in series. Parallel blocks have generally been found not to be useful, due to difference in tolerances between the blocks, such that one of the blocks may be more prone to carrying current than the others.

The claims defining the invention are as follows:

1. A fuse arrangement, comprising a fuse link mountable in series with a current carrying circuit, and an energy absorbing device connectable in parallel with the fuse link and arranged, on operation of the fuse arrangement on the occurrence of a fault current in the current carrying circuit, to absorb electrical energy associated with the fault current, the fuse link being arranged to generate a relatively high voltage on commencement of fusing and the energy absorbing device operating on occurrence of the relatively high voltage, whereby the fault current is commutated to the energy absorbing device on commencement of fusing, wherein the fuse link comprises a fuse element mounted in a fuse carrier, the fuse carrier being arranged to mechanically "dropout" from the current carrying circuit on operation, the carrier being associated with the energy absorbing element in such a manner that on "dropout" of the carrier the energy absorbing element is also disconnected from the current carrying circuit, whereby to break the current carrying circuit.

2. A fuse arrangement in accordance with claim 1, the operating parameters of the fuse link and energy absorbing device being such that, on fuse operation, current initially flowing in the fuse link is commutated to the energy absorbing device.

3. A fuse arrangement in accordance with claim 2, the energy absorbing device being arranged to operate on the application of a relatively high voltage and the fuse link being arranged to generate the relatively high voltage in a relatively short time on fuse link operation.

4. A fuse arrangement in accordance with claim 2 wherein the energy absorbing device comprises a resistance element for limiting current flow.

5. A fuse arrangement in accordance with claim 4, wherein the resistance element comprises a varistor.

6. A fuse arrangement in accordance with claim 5, wherein the varistor comprises a zinc oxide varistor.

7. A fuse arrangement in accordance with claim 1, wherein the energy absorption device is mounted separately from the fuse carrier and terminal connections are provided to electrically connect the energy absorbing device to the fuse link, the terminal connections being automatically disconnected on "dropout" of the carrier.

8. A fuse arrangement in accordance with claim 1, wherein the energy absorbing device is physically mounted on the carrier and is automatically disconnected from the current carrying circuit on "dropout" of the carrier.

9. A fuse arrangement in accordance with claim 1, wherein the fuse comprises a "deeply confined" expulsion fuse.

10. A fuse arrangement in accordance with claim 1, wherein the fuse comprises a simple sand fuse.

11. A fuse arrangement in accordance with claim 1, the arrangement incorporating a mechanical triggering device arranged to operate a load break switch and adapted to be mounted in a metal or plastics enclosed switch gear, indoor or pad mounted substation.

12. A fuse arrangement in accordance with claim 9, wherein the fuse comprises a fuse element mounted within a narrow diameter ablative tube.

13. A fuse arrangement, comprising:

(a) a fuse link mounted in series with a current carrying circuit and of the type that generates a relatively high voltage on commencement of fusing, wherein the fuse link comprises a fuse element mounted in a fuse carrier, wherein during operation said fuse carrier is adapted to mechanically "dropout" from the current carrying circuit, said carrier being associated with the energy absorbing member in such a manner that on "dropout" of the carrier the energy absorbing member also disconnects from the current carrying circuit, thereby breaking the current carrying circuit; and (b) an energy absorbing member connected in parallel with the fuse link and of the type that absorbs electrical energy associated with a fault current, said energy absorbing member operating on occurrence of the relatively high voltage, whereby said fuse arrangement operates on occurrence of a fault current in the current carrying circuit such that when fusing begins the fault current is commutated to the energy absorbing member.

14. The fuse arrangement as recited in claim 13, wherein the energy absorbing member comprises a resistance element for limiting current flow.

* * * * *